United States Patent [19]

Matsui

[11] Patent Number: 4,678,099

[45] Date of Patent: Jul. 7, 1987

[54] CONTAINER FOR STORING STACK OF THIN AND SOFT SHEET MATERIALS

[76] Inventor: Sumio Matsui, 5-7, Kitami 9-chome, Setagaya-ku, Tokyo, Japan

[21] Appl. No.: 783,342

[22] Filed: Oct. 2, 1985

[30] Foreign Application Priority Data

Feb. 19, 1985 [JP] Japan ..... 60-29390
Aug. 29, 1985 [JP] Japan ..... 60-188504

[51] Int. Cl.[4] ..... B67H 1/00
[52] U.S. Cl. ..... 221/48; 221/55
[58] Field of Search ..... 206/494, 449; 221/47, 221/48, 50, 55, 63, 64, 260, 307, 309, 310, 303

[56] References Cited

U.S. PATENT DOCUMENTS

| | | | |
|---|---|---|---|
| 1,744,644 | 1/1930 | Kruder et al. | 221/48 |
| 2,295,005 | 9/1942 | Peacock et al. | 221/48 |
| 2,323,395 | 7/1943 | Harwood | 221/48 |
| 2,334,536 | 11/1943 | Broeren et al. | 221/48 |
| 2,761,676 | 9/1956 | Sabee et al. | 221/50 |
| 3,133,672 | 5/1964 | Thomasma et al. | 221/260 |
| 4,458,810 | 7/1984 | Matoney | 206/494 |

FOREIGN PATENT DOCUMENTS

| | | | |
|---|---|---|---|
| 1112680 | 5/1968 | United Kingdom | 221/63 |

*Primary Examiner*—H. Grant Skaggs
*Attorney, Agent, or Firm*—Charles E. Baxley

[57] ABSTRACT

A container for storing a stack of thin and soft sheet materials is provided. The container has a discharge port on the underside of the container through which the stacked sheet materials are dispensed one by one. The discharge port is defined by at least one pair of opposing flexible lugs and is enlarged by the sheet materials. When a sheet is drawn out of the container, one of the flexible lugs is contacted by the sheet and is pushed down so that the discharge port is enlarged to facilitate dispensing. Then the other one of the flexible lugs is contacted by the sheet and pushed down.

4 Claims, 28 Drawing Figures

CONTAINER FOR STORING STACK OF THIN AND SOFT SHEET MATERIALS

BACKGROUND OF THE INVENTION

1. Field of the Invention

The present invention relates to a container for storing a stack of thin and soft sheet materials, such as tissue paper sheets, toilet paper sheets or paper towel sheets commonly used for household and hygienic uses. More particularly, the invention is directed to an improvement in sheet material dispenser means through which sheets of paper or like materials are drawn out of the container readily and smoothly without being broken during the dispensing operation by a user, whereby the capacity of the container for storing sheet materials per unit volume can be increased.

2. Related Art Statement

In general, paper sheet materials used for hygienic uses, such as tissue paper, toilet paper or paper towels, are thin and soft, and have high water absorption coefficients and low tearing strengths. such paper sheets are cut to have predetermined dimensions, folded in half, and then stacked in a container with the folded halves thereof being inserted or tucked in the folded halves of the adjacent sheets. Most of the known containers for storing such a stack of paper sheets for hygienic or like uses have discharge or dispensing ports opening on the top walls thereof. However, when a paper sheet stack is contained in such a container having a dispensing port opening on the top wall, at least a portion of the paper sheet next to the sheet which has been or is just drawn out of the container must be pulled from the container to be ready for picking by the user's fingers, the portion of the next sheet being pulled out of the container by the accompanying movement thereof with the preceding sheet. With such a construction, the height of the container or the thickness of stacked and overlaid paper sheets should be less than the width of the folded and tucked section of each sheet, when it is desired to draw and consume all of the packed sheets including the last or lowermost paper sheet in a convenient manner. For this reason, the number of paper sheets which can be packed in a single container is limited. Another disadvantage of the conventional container of this type is that failure in pulling up the portion of the next sheet to the dispensing port occurs frequently to compel the user to insert the fingers deep into the container to draw up the paper sheets laid at the lower portion of the container.

There is also known a container for packing a paper sheet stack and having a dispensing port on the bottom wall thereof. A container of this type has an advantage that all of the paper sheets including the very last sheet can be dispensed from the container without any particular difficulty, since the paper sheets move spontaneously towards the bottom of the container by gravity as they are consumed. However, in the conventional container of this type, since the weight of all sheets stacked in the container is applied on the downmost paper sheet to create excessive frictional force when the downmost paper sheet is drawn through the dispensing port, a thin and soft sheet, such as tissue paper, having only limited low mechanical strength is apt to be broken during the pull-out operation especially when a large number of sheets is contained in the packed stack. Accordingly, the number of soft and thin sheets having relatively low strengths is also limited when they are packed in a conventional container of this type.

OBJECTS AND SUMMARY OF THE INVENTION

A primary object of this invention is to provide a novel container for containing therein a stack of thin and soft sheet materials, the sheets contained therein being greatly increased in number as compared with the known containers used for the same purpose, so that the sheets may be easily drawn therefrom successively without a fear of breakdown.

Another object of this invention is to provide such a container for containing therein a stack of thin and soft sheet materials which may be easily and securely drawn from the container from the first sheet to the last sheet without a fear of breakdown.

A further object of this invention is to provide such a container which can contain a larger number of thin and soft sheet materials than the number of the sheet materials of same thickness and quality which are containable in the conventional container of same dimensions.

The above and other objects of this invention will be fully understood from the following description.

In summary, according to the present invention there is provided a container having a discharge port on the underside of the container and for containing therein a stack of thin and soft sheet materials having edges tucked in the overlapping folded portions of the adjacent sheets with one another so that after dispense of one sheet the leading end of the next sheet protrudes through the discharge port to be ready for the next dispensing operation by a user. The discharge port is defined by at least one pair of opposing flexible lugs and is enlarged by each sheet when it is drawn out of container while contacting with and pushing down initially one of the flexible lugs and then contacting and pushing down the other one of the flexible lugs.

Figure 2A:
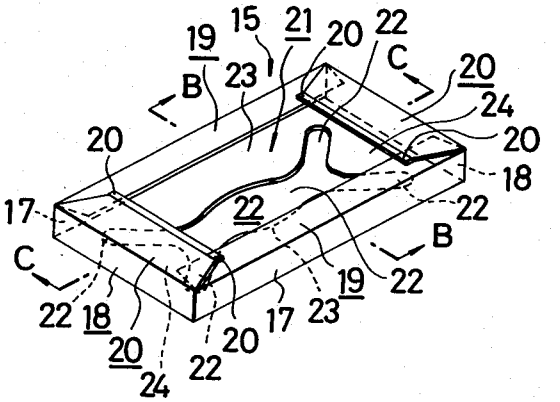
Figure 2B:
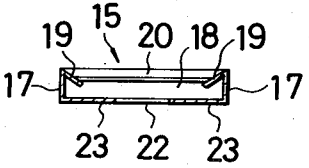
Figure 2C:
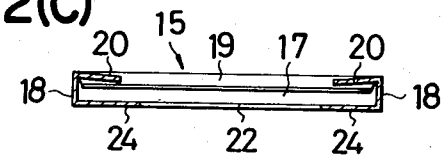
Figure 1:
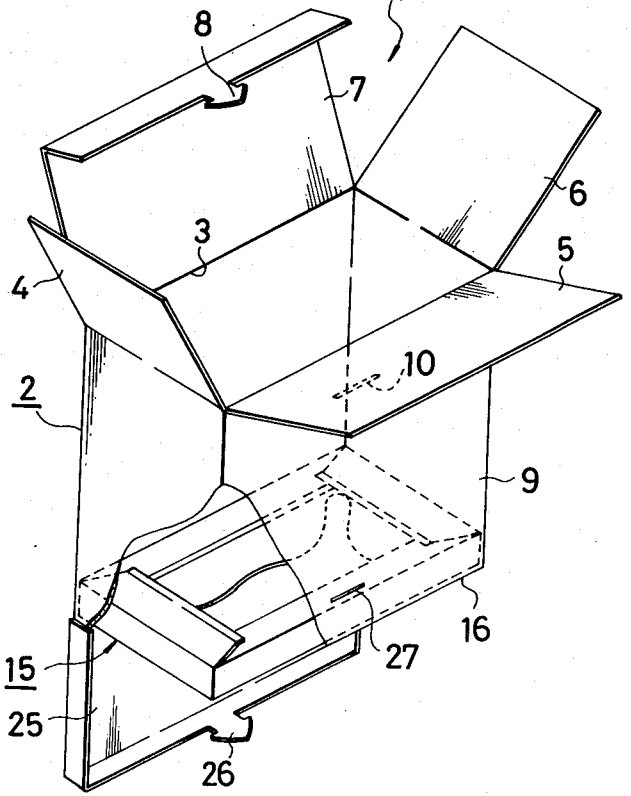
FIG. 1 is a perspective view, partly broken away, of a first embodiment of the container of the invention with the top and bottom walls or lid portions opened, FIG. 2 (A) is a perspective view of the dispenser unit assembled in the contaienr of FIG. 1, FIG. 2 (B) is a sectional view taken along line B—B in FIG. 2 (A), and FIG. 2 (C) is a sectional view taken along line C—C in FIG. 2 (A)
Figures 4A, 4B, 4C, 4D:
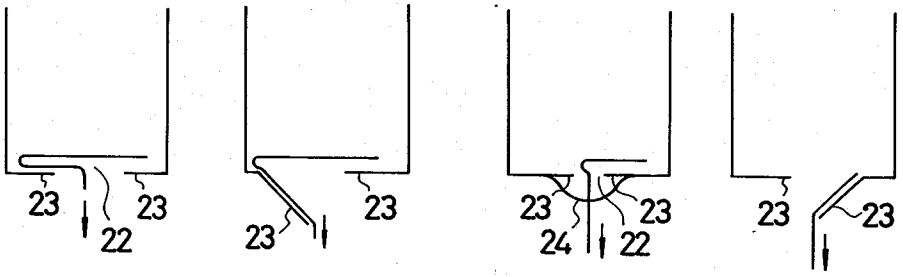
FIGS. 4(A), 4(B), 4(C) and 4(D) show the principal functions of the flexible lugs of the first embodiment of the invention, FIG. 4 (A) showing a sheet stationarily contained with one end thereof projecting out of the container, FIG. 4 (B) showing the sheet which has been drawn to reach a condition at which the pulling force is transmitted to act directly or straight on the folding line, FIG. 4 (C) showing the condition at which the pull-out force is applied on the half section of the sheet, and FIG. 4 (D) showing the condition at which the pull-out force is transmitted substantially straight to the other end of the sheet.
Figures 5A, 5B, 5C:
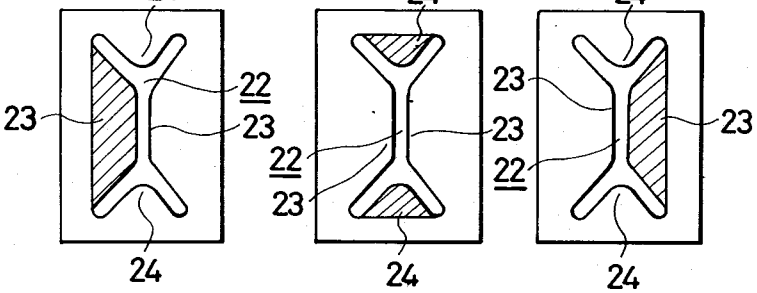
FIG. 5(A), 5(B) and 5(C) show diagrammatically the lugs bent by the sheet which is pulled out of the container, wherein the condition shown in FIG. 5(A) corresponds to the condition shown in FIG. 4(B), FIG. 5(B)
Figure 8A:
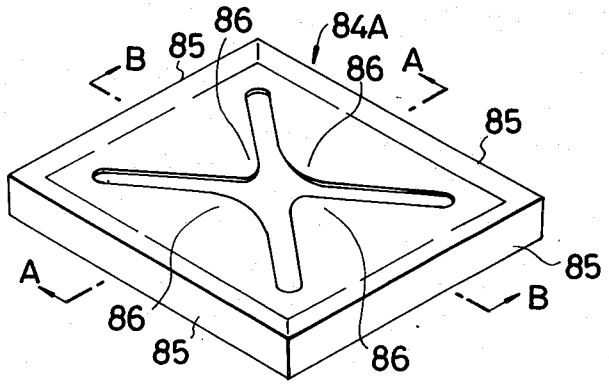
Figure 8B:
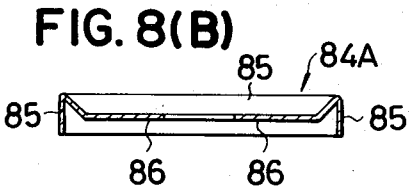
Figure 8C:
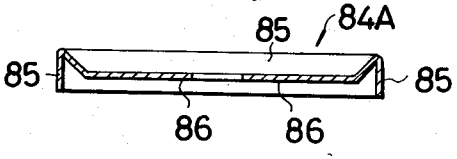
Figure 7:
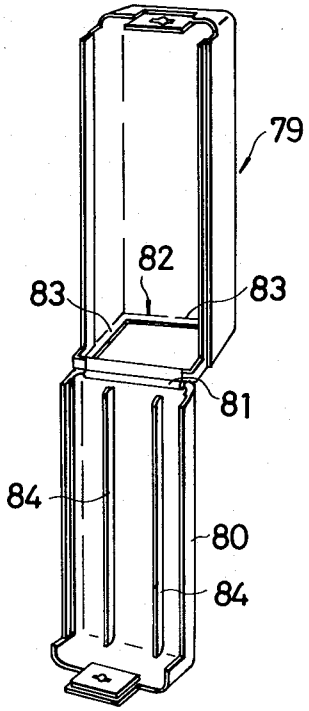
Figure 6:
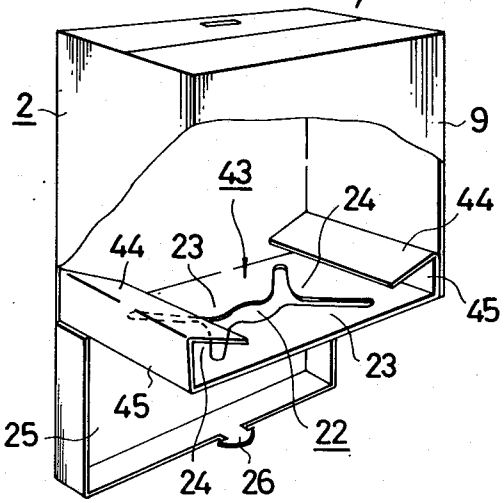
Figure 10A:
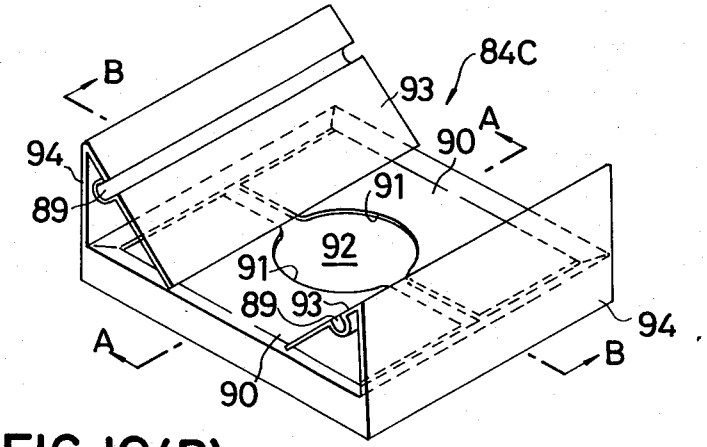
Figure 10B:
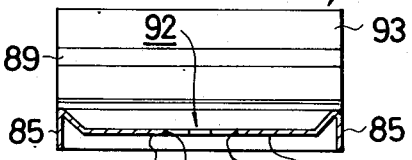
Figure 10C:
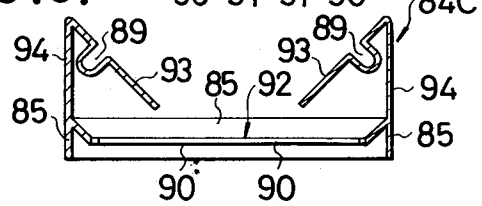
Figure 9A:
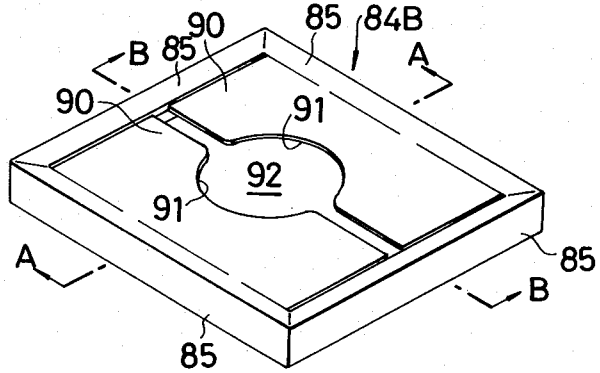
Figure 9B:
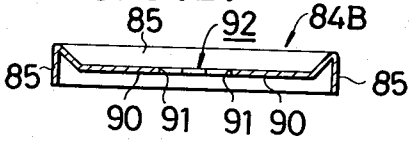
Figure 9C:
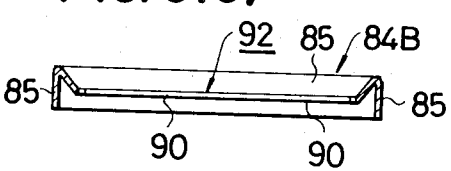
Figure 13:
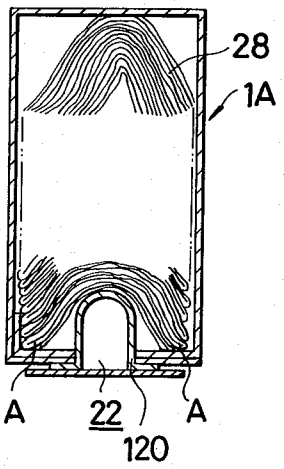
Figure 14:
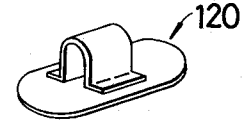
Figure 12:
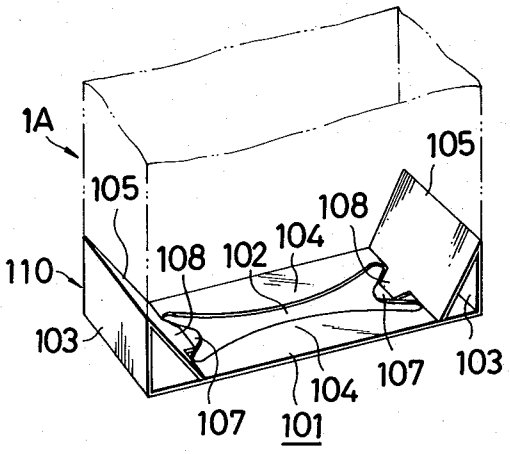
Figure 11:
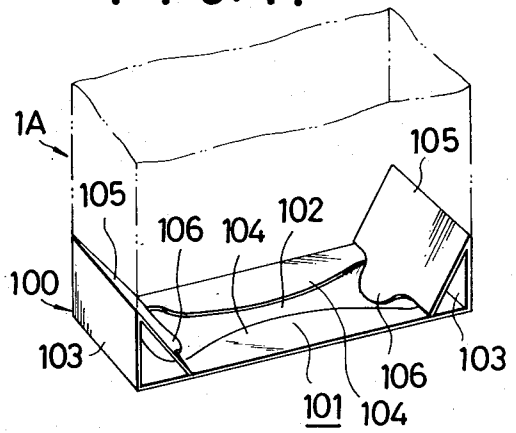
Figure 15:
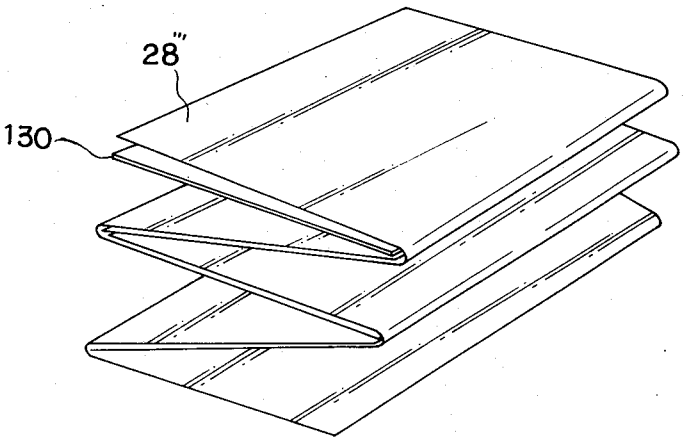

corresponds to the conditions shown in FIGS. 4 (C), and the condition shown in FIG. 5(C) corresponds to the condition shown in FIG. 4 (D);

FIG. 6 is a perspective view, partly broken away, of another embodiment of the container of the invention with the top and bottom walls or lid portions opened;

FIG. 7 is a perspective view showing a housing of the container according to a further embodiment of the invention;

FIGS. 8(A), 8(B) and 8(C) are views of one form of dispensing unit;

FIGS. 9(A), 9(B) and 9(C) are views of another form of dispensing unit;

FIGS. 10(A), 10(B) and 10(C) are views of a still further dispensing unit;

FIG. 11 is a perspective view showing another dispensing unit which may be assembled with the housing of the container shown in FIG. 1;

FIG. 12 is a perspective view showing a further dispensing unit which may be assembled with the housing of the container shown in FIG. 1;

FIG. 13 is a schematic illustration showing the stack of sheet materials, in section, packed in a container;

FIG. 14 is a perspective view showing a holder, according to the invention, adapted to be attached to the bottom of the container shown in FIG. 13; and FIG. 15 is a perspective view showing a relatively rigid sheet inserted between folded halves of the uppermost sheet of the stack of thin and soft sheet materials;

DESCRIPTION OF THE EMBODIMENTS

Referring first to FIGS. 1 to 5, an embodiment of the invention will be described. A container 1A shown in FIG. 1 is made of a durable and relatively light weight material, such as hard paper board or corrugated paper board, or plastics materials. The container 1A comprises a housing or casing 2 having a horizontal cross section of substantially rectangular shape. The housing 2 has an upper opening 3 defined by four peripheral edges from which flaps 4, 5, 6 and 7 extend integrally with the walls of the housing 2. When it is desired to close the opening 3, flaps 4 to 7 are folded to cover the opening 3 and a hook 8 provided at the free edge of the flap 7 is inserted into a hook receiving slot 10. The upper opening 3 is normally closed by the flaps 4 to 7 when the container is in use, and may be opened to receive therethrough supplemental sheet materials, such as paper tissues, in the housing 2.

Reference numeral 15 designate a dispenser unit disposed to cover the bottom opening 16 of the housing 2. Details of the dispenser unit 15 will now be described with reference to FIG. 2. The dispenser unit 15 of this embodiment has a generally rectangular cross section substantially coextensive with the interior contour of the bottom opening of the housing 2 so that it is snugly inserted in the housing 2. The dispenser unit 15 has opposing longitudinal walls 17, 17 and side walls 18, 18. The upper edges of the longitudinal walls 17, 17 are bent inwardly of the housing 2 to form a pair of flexible upper bolster members 19, 19, and likewise the upper edges of the side walls 18, 18 are bent inwardly of the housing 2 to form another pair of flexible upper bolster members 20, 20. The dispenser unit 15 has a bottom 21 which is cut to provide a discharge port 22 and to form four flexible lugs or segments 23, 23, 24, 24.

The flexible upper bolster members 19 and 20 are formed by bending the edges of the walls 17 and 18 so that the bent sections thereof extend substantially perpendicular to the upstanding wall portions, and the upper bolster pair 20 is carried by the upper bolster pair 19 extending along the longitudinal walls of the housing so that the resiliency and the weight bearing force thereof are enhanced. Each of the side edges of the upper bolster 20 is converged so that each of the upper bolster members 20 has a generally trapezoidal shape. With this shape, when the upper bolster pairs 19 and 20 are flexed downwards by a sheet of material placed thereon, the converged side edges of the bolster members 20 contact closely with the upper surface of the bolster members 19 to prevent the sheet of material from being nipped in the gaps otherwise formed between the bolster members 19 and 20 to obviate the jamming problem.

As has been described hereinbefore, the bottom 21 is cut to provide the discharge port 22 which is formed of a center opening 22 extending along the longitudinal direction and four terminal channels 22 extending from the corners of the center opening 22 obliquely toward the corners of the bottom 21, whereby two pairs of opposing flexible segments or lugs 23 and 24 are formed to surround the discharge port 22.

Each of the upper bolster members 19 and 20 exerts a spring action against the downward gravitational force caused by the weight of a sheet material stack when it is flexed about the corresponding upper edge of the wall portion 17 or 18, so taht the sheet material stack is resiliently borne thereby. Since the bottom 21 is also formed of a flexible material, each of the flexible lugs 23 and 24 bears the weight of the charged paper sheet stack indirectly, although this being a secondary important function, similar to the function of each of the upper bolster members 19 and 20. The functions of the upper bolster members 19 and 20 and the functions of the lower flexible lugs 23, 24 will be described in detail hereinafter.

Now referring back to FIG. 1, reference numeral 25 designates a dressing cover hinged to the rear edge of the bottom opening 16 and having a front edge provided with a hook 26 which may be inserted into a hook receiving slot 27 to close the bottom opening 16 of the housing 2. By closing the bottom cover 25, the bottom opening 16 may be closed to prevent dust from entering into the housing and to prevent damage of the container particularly during transportation. Needless to describe, since the mechanical strength of a housing is enhanced by closing all openings, rather than having one side or face left opened, the dressing cover 25 is provided to obviate breakdown or damage of the container which otherwise might occur during transportation. Since the dressing cover 25 is generally dispensable when the container 1A is placed at a desired location, a perforation or roulette is provided along the rear hinged edge of the cover 25 so that the dressing cover may be easily broken away from the housing 2 after setting.

Meanwhile, although the housing 2 and the dispensing unit 15 are formed separately and then they are assembled in the embodiment illustrated hereinabove, they may be formed integrally from a sheet of hard paper board or like material.

Figure 3:
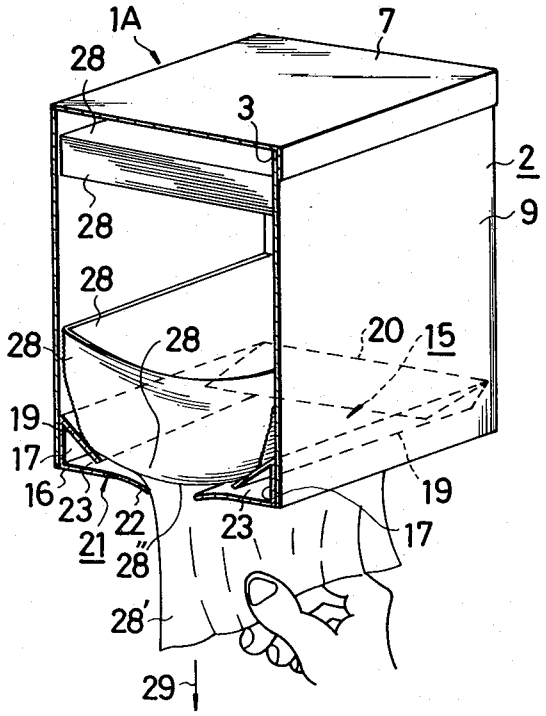
FIG. 3 is a perspective view, partly broken away, of the container of FIG. 1, showing a paper sheet contained in the housing of the container during the dispensing or drawing opeation.

The operation of dispensing a sheet material from the sheet stack packed in the container 1A will be described. In FIG. 3, reference numeral 28 designates a stack of tissue paper sheets which are piled in the housing 2 with their folded halves tucked in the overlapping folded portions of adjacent tissue paper sheets, the stack of tissue paper sheets being charged in the housing 2 while keeping the flaps 4 to 7 in the open condition. In this Figure, tissue paper sheets forming the intermediate portion of the stack are omitted for simple illustration.

When a stack of tissue paper sheets 28 is contained to form a pile, the peripheral portions of the downmost sheet are carried by the flexible upper bolster members 19 and 20 extending inwardly of the housing 2 with the central portion being warped downwards. The central portion of the downmost sheet contacts the bottom plate 21 whereupon the discharge port 22 is closed by the central portion of the warped sheet. As a result, the weight of the stack of tissue paper sheets in thus supported by the upper bolster pairs 19 and 20, with the central portion of the stack being supported by the bottom plate 21. Since the upper bolster members 19 and 20 and the flexible lugs 23 and 24 serve as resilient spring members, as described above, the biasing forces applied thereon due to gravitational force are sustained by the restoring forces exerted by these members.

As the peripheral portions of the lowermost sheet of the tissue paper are supported resiliently or flexibly by respective upper bolster members 19 and 20, the degree of downward warping of the central portion of each sheet increases as a specific sheet moves closer to the bottom, so that the area of the peripheral portions of respective sheets above the bolster members is decreased as they move downward with the contacting area of the lowermost sheet decreased to the minimum extent. As a result, the resistance to separation due to frictional force at the pull-out operation is minimized.

Moreover, as the result of flexible or resilient support of the peripheral portions of the paper sheet stack, the tissue paper sheets become loose as they move downwards. This also contributes decrease in frictional force resisting against pull-out of the lowermost sheet at the dispensing operation, and the tension otherwise concentrated locally in a small area on the lowermost sheet just being dispensed from the container is dispersed over and shared by the whole area of the sheet.

Furthermore, as the result of flexible or resilient support of the peripheral portions of the paper sheet stack, the direction of the force created by the gravitation or weight of the tissue paper stack, i.e. the force due to gravitation directing originally in the vertical direction, is diverged in inclined directions toward the discharge port 22.

It should be understood from the foregoing that the upper bolster members 19 and 20 exhibit advantageous functions to facilitate easy dispensing of the tissue paper sheet or sheets moved to the lowermost or lower portion of the stack remarkably, as the extremely favourable functions including the function of flexible or resilient support of the peripheral portions of the sheets, the function of decreasing the overlapping areas between the adjacent sheets at the peripheral portions, the function of decreasing the contacting area between the bolster members and the peripheral portions of the lowermost sheet, and the function of diverging the vertical force created by the weight of the stack of paper sheets into inclined diections.

Since the upper bolster members 19 and 20 are flexible, they are flexed by the action of the weight of the paper sheet stack so that the supporting faces thereof are inclined downwards in the directions towards the center of the sheet. As a result of such deflection or restorable deformation of the upper bolster members, paper sheets can be aligned in pertinent location as they are moved towards the discharge port even if some of them are dislocated at improper positions.

As will be apparent from the preceding explanations, the lowermost tissue paper sheet 28' of the tissue paper sheet stack 28 is smoothly drawn out of the container while being applied with minimized loading caused by the overlapping sheets of the stack 28 ----. In dispensing operation of the lowermost sheet, the flexible lugs 23 and 24 surrounding the discharge port 22 on the bottom 21 exhbit the following functions.

FIG. 4 (A) is a sectional view taken along the side walls of the housing of a container 1A in which a stack of tissue paper sheets 28 is contained. For simplicity of illustration, only one sheet, the lowermost sheet 28', is shown in this Figure and the following FIGS. 4 (B) to 4 (D). One end of the lowermost sheet 28' has been drawn through the discharge port 22 and extends downwards. As the end extending through the discharge port 22 is pulled downwards, the already drawn section of the folded sheet 28' urges one of the flexible lugs 23, the lug or flexible segment denoted by oblique lines in FIG. 5 (A) extending along the longitudinal direction, to be flexed to enlarge the discharge port, as exaggeratedly shown in FIG. 4 (B). As the sheet is drawn and the pulling force is transmitted to act directly on the folding line of the folded tissue paper sheet 28', the upper half of the folded sheet 28' is drawn until the point of pulling force application reaches the center of the upper half section, as shown in FIG. 4 (C). At this stage, the of the flexed lug 23 is released from the downward urging force to be restored gradually, whereas the pair of flexible lugs 24 begins to be flexed. When the pulling force is applied on the substantial center of the sheet 28', the last mentioned lug 23 is restored. As the tissue paper sheet 28' is pulled further, the other of the pair of flexible lugs 23, the lug or flexible segment denoted by oblique lines in FIG. 5 (C) extending along the longitudinal direction, opposite to the other lug 23 begins to be flexed downwards. At this stage, the pair of flexible lugs 24 extending along the shorter side walls of the housing is restored gradually as the force applied thereon by the drawn sheet 28' is decreased. After then, the upper half of the sheet 28' slidably moves along the flexed lug 23, as shown in FIG. 4 (D), and finally the terminal end of the sheet 28' leaves the container to complete one cycle of the dispensing operation. Then, the other flexible lug 23 is restored.

The functions of the flexible lug pairs 23 and 24 will now be described while referring to interrelation of each lug with the other lugs.

Referring to FIG. 3, as the lowermost tissue paper sheet 28' is pulled, one of the pair of flexible lugs 23 is flexed depending on the pulling force applied on the drawn tissue paper sheet 28' (the pulling force being denoted by arrow 29 in the Figure), whereas the other flexible lugs 23, 24 and 24 are left unflexed since no pulling force is applied thereon. Under this conditions, the major portion of the weight of the stack of tissue paper sheets 28 --- is carried by the unflexed lugs 23, 24 and 24, and a gap is formed between the lowermost sheet 28' and the tissue paper sheet 28'' next to the drawn sheet 28' as the one of the lugs 23 is flexed downwards so that the lowermost sheet 28' may be drawn through the discharge port 22 smoothly while having only a little loading caused by the weight of the overlapping tissue paper sheets 28. One half of the tissue paper sheet 28'' tucked in-between the lower and upper halves of the drawn sheet 28' accompanies the upper half of the sheet 28' so that one end of the sheet 28'' protrudes through the discharge port 22 after the completion of dispensing the lowermost sheet 28'.

Since the tissue paper sheets 28 are stacked with their lower folded halves tucked in-between the lower and upper halves of the preceding sheet, i.e. the lower adjacent sheet, and with their upper folded halves tucked in-between the next sheet, i.e. the upper adjacent sheet, in an alternate fashion, one end of the tissue paper sheet 28'' next to the lowermost tissue paper sheet 28' is pulled out of the discharge port 22 so that the next sheet 28'' is drawn initially from the half supported by the other lug 23 (the right lug 23 as viewed in FIG. 3) which is opposing to the lug 23 (the left lug 23 as viewed in FIG. 3) initially flexed by the drawn sheet 28'.

As described hereinbefore, by the use of the embodiment of the container constructed in accordance with the invention, when a large number of thin and soft sheets materials, such as tissue paper sheets, is stacked therein, the entire weight of the overlaid sheets is carried by the obliquely flexed surfaces of four upper bolster members respectively projecting inwards from four walls of the container housing, whereby the central portions of stacked paper sheets are warped increasingly as they move downwards in the container housing so that the paper sheets located in the lower portion of the stack become loose and the areas of peripheral portions thereof supported by respective bolster members are decreased as they move downwards, and the loading force originally created by the weight or gravitational force of the overlapping sheets in vertical direction is applied on a sheet in the lower portion of the stack as diverged forces inclined from the vertical direction. Moreover, the flexible lugs or segments surrounding the discharge port are successively flexed downward to provide a gap between the lowermost sheet and the sheet next to the lowermost sheet during the dispensing operation of the lowermost sheet so that the loading applied on the sheet just being pulled out of the container is reduced to decrease the frictional force to facilitate easy dispensing of the lowermost sheet while minimizing the fear of the breakdown.

By the use of the container, according to the invention, with the construction as aforementioned, the lowermost sheet can be drawn out easily without the fear of tearing or other damages. Accordingly, a large number of overlapping sheets of material may be stacked and contained in the container of the invention to satisfy the needs arising depending on the applied uses, the set position, expected number of users and the frequency in consuming the content sheets in the container.

A large number of sheet materials thus stored in the container is successively dispensed from the bottom with the remainder of the contained sheets of material moving spontaneously by gravitational force so that all sheets including the last sheet may be securely and easily dispensed from the container. Supplementary sheets of material may be, of course, supplied through the upper opening of the container housing at any time as necessity arises.

Although tissue paper sheets have been charged in the housing of the container 1A in the foregoing description of the first embodiment of the invention, the container may be charged with any thin and soft sheet materials, particularly used for hygienic applications, the examples being toilet paper, makeup paper and paper towels. The container 1A, constructed in accordance with the invention, may be used for household uses and for business uses in offices, hotels and restaurants.

A soft and thin sheet material of continuous long sheet form, other then the cut and folded pile as shown in FIG. 3, may be contained in the container of the invention merely by folding the continuous web of such a material.

FIG. 6 shows a second embodiment of the container of the invention for containing thin and soft sheets therein. The only difference between this embodiment and the first embodiment shown in FIG. 1 is that the upper bolster members in the container 1A of the first embodiment are replaced by distinctive upper bolster members in the container 1B of this embodiment. Accordingly, the container 1B will be described hereinbelow simply by omitting repeated description of the parts same as those of the container 1A.

Referring to FIG. 6, a dispenser unit 43 has a pair of upper bloster members 44 and 44 and a bottom plate section formed with flexible lugs or segments 23, 23, 24 and 24, and the upper bolster members and the bottom plate section are formed of a single flexible plate material. In detail, both ends of a generally rectangular paper board are bent to form upper flexible bolster members or lugs 44, 44, and the portions adjacent to the flexible lugs 44, 44 are bent to form auxiliary side walls 45, 45, the generally rectangular center section of the paper board having dimensions snugly fitted and fixed to the lower opening of a housing 2. The center section is provided with a discharge port 22 which is defined and surrounded by lower flexible lugs 23, 23, 24 and 24. The thus formed dispenser unit 43 is fitted and fixed in the housing 2 at a position adjacent to the lower opening by securing the auxiliary walls 45 and 45 to the side walls of the housing 2 by an adhesive. Meantime, the container 1B, according to this embodiment of the invention, may be assembled from a separate housing 2 and dispenser unit 43 as described above, or alternatively a sheet of paper board may be punched to have an appropriate shape followed by bending to form the desired container.

With the upper flexible bolster members 44, 44 and the lower flexible lug pairs 23 and 24 exhibiting the same functions as those of the upper flexible bolster members 20, 20 and the lower flexible lugs pair 23, 23 and 24, 24, the tissue paper sheets contained in the container 1B can be easily dispensed therefrom, in addition to a further advantage that the container 1B can be manufactured very simply at a low cost.

A further embodiment of the container for containing a stack of thin and soft sheet materials, according to the invention, may be assembled in combination of a casing shown in FIG. 7 with any one of the dispenser units shown in FIGS. 8 to 10.

A casing 79 shown in FIG. 7 is made of a synthetic resin having a front opening as shown in the Figure, and a cover 80 is attached thereto by hinge means 81 disposed at the lower end edge of the casing 79 to be opened or fixed to a closing position. A bottom 82 of the casing 79 is cut away while leaving peripheral frame or rims 83. Two parallel ribs 84 extend on the inner face of the cover 80 substantially along the entire longitudinal length of the cover 80. These ribs are provided for restraining or pressing one edge of stacked sheet materials, such as tissue paper or toilet paper sheets, onto the opposing rear wall of the casing 79 when the latter is closed by the cover 80 so as to prevent dislocation of sheet materials. Any one of the following dispenser units may be placed on the rims or framework 83 at the bottom 82 of the casing 79.

The unit shown in FIG. 8 is an embodiment of the dispenser unit which may be assembled in the aforementioned casing 79. In the dispenser unit 84A shown in FIG. 8, two pairs of flexible lugs or segments 86 are provided in a coplanar plate, each pair of lugs 86, 86 being of tongue like shape extending from the inner peripheral edges of the generally rectangular frame 85.

FIG. 9 shows another embodiment of the dispenser unit which may be assembled in the casing 79. The dispenser unit 84B shown in FIG. 9 is provided with a pair of opposing flexible segments or lugs 90 in the same plane. Each of the opposing flexible segments 90 has a generally rectangular shape and extends from the edge of one longitudinal periphery of a rectangular frame 85 with the center portion 91 cut away to form a generally semicircular opening. A paper sheet dispensing port 92 is defined by a zone surrounded by the semicircular cut-away portions 91 of the opposing segments 90 and the slots or gaps between the opposing segments 90.

FIG. 10 shows a further embodiment of the dispenser unit which may be assembled in the casing 79. The dispenser unit 84C shown in FIG. 10 is provided with an additional pair of opposing segments 93 and 93 above a similar construction as of the dispenser unit 84B shown in FIG. 9. The pair of upper flexible segments 93 and 93, which serve as upper bolster members, extends obliquely in downward directions from each upper edge of the opposing side walls 94 and 94 upstanding from the walls other than those from which the lower flexible lugs 90, 90 extend. The free end of each upper bolster member 93 crosses each of the lower flexible lugs 90 at a right angle. Each of the upper bolster members 93, 93 is provided with a transverse ridge 89 formed by crimping the bolster member. The transverse ridge 89 is provided to increase the flexibility and restoring force of the upper bolster member 93.

Any one of the dispenser units 84A, 84B and 84C may be placed on the framework 83 on the bottom 82 of the casing 79 to assemble a container.

All of the aforementioned dispenser units 84A, 84B and 84C provide similar remarkable effects as obtainable by the first embodiment shown in FIG. 1.

FIG. 11 shows another form of the dispenser unit, according to the invention, assembled with the container 1A of FIG. 1. In this embodiment, a bottom plate 101 has an opening 102 extending longitudinally at the center region of the plate 101, the width of the opening 102 being enlarged as it approaches to the side walls 103 and 103, so that a pair of opposing flexible lugs 104 and 104 is formed along the longitudinal edges of the opening 102. The upper portions of sides walls 103 and 103 are bent to form upper flexible bolster members 105 and 105. Each of the upper flexible bolster members 105 and 105 has a tip end 106 which forms a projection to be inserted through the widened region of the opening 102. Since each upper flexible bolster members 105 is inclined downwards as shown in FIG. 11, the projection 106 thereof extends obliquely beyond the bottom of the container 1A.

By the use of the dispenser unit of this embodiment having a pair of opposing upper flexible bolster members 105 and 105 which have no stepwise change along the guiding face and are inclined downwards with their projecting tip ends extending through the discharge opening 102, tissue paper sheets contained therein can be guided very smoothly to be dispensed easily. Since the major portion of the weight of the sheet material stack is loaded on and supported by the upper flexible bolster members 105 and 105, the frictional force between the sheet drawn from the container and the lower flexible lugs 104 and 104 is reduced to a minimal extent to facilitate easier dispensing thereof.

FIG. 12 shows a modified embodiment 110 of the dispenser unit as shown in FIG. 11. Since this embodiment has a similar construction and a number of the same parts or portions as in the embodiment of FIG. 11, only the distinctive portions and functions thereof will be described. The dispenser 100 shown in FIG. 11 has the opening 102 defined or surrouded by a single pair of lower flexible lugs 104 and 104, whereas an additional pair of opposing lower flexible lugs 107 and 107 is provided radially perpendicular to the lugs 104 extending in the longitudinal direction. In this modified embodiment, the projecting tip ends 108 of the upper bolster members 105 are truncated and the truncated ends are placed on the corresponding lugs 107 of the lower flexible lugs 107 so that the lower flexible lugs 107 are projected downwards in the inclined directions. When a sheet of tissue paper is dispensed from the container of this embodiment, it is guided by the upper bolster members 105 and 105 until it is moved closely to the opening 102 with the lower flexible lugs 107 and 107 inclined for guiding beyond the opening 102, whereby the tissue paper sheet can be drawn very smoothly.

FIG. 13 shows another embodiment of the container housing 1A which has a narrower width for adapting to contain a stack of tissue paper sheets 28 with the central zone raised upwards. In this embodiment, a significant fraction of the weight of the sheet material stack is applied concentratedly on the areas A, A at the vicinities of the peripheral portions of the bottom plate close to the side walls, whereby the loadings applied on the lower flexible lugs 23, 23, 24, 24 are considerably reduced. As a result, the fear of tearing or breackdown of weak tissue paper or other sheet materials due to the frictional force at the pulling out operation can be obviated. With a holder 120 inserted in the opening 22, as shown in FIG. 14, the sheet material stack may be held at the condition with the center portion held in a raised contour prior to use.

As shown in FIG. 15, relatively rigid sheet of material 130 may be inserted between the folded halves of the last or uppermost sheet 28''' to prevent the remaining sheets from being drawn out of the opening 22 when one sheet is pulled from the last group of sheets after the number of remaining sheets is decreased to an extent such that a group of soft sheets is apt to accompany the sheet pulled by a user, whereby the very last thin and soft sheet 28''' is securely held in the container until it is desired to dispense the same out of the container.

Although the invention has been described by referring to preferred embodiments thereof, it is not intended to limit the invention by the illustrated embodiments. It is intended to embrace all modifications and alterations within the scope of the invention as far as they are included in the broad aspect of the invention as defined in the appended claims.

What is claimed is:

1. A container having a discharge port on the underside of said container for containing therein a stack of thin and soft sheets of material having edges overlapping folded portions of adjacent sheets so that after dispensing of one sheet a leading end of a next sheet protrudes through said discharge port to be ready for a subsequent dispensing operation by a user, said discharge port being defined by a least one pair of opposing flexible lugs and being enlarged by said one sheet when the sheet is drawn out of the container while contacting and pushing down initially one of said flexible lugs and then contacting and pushing down the other one of said flexible lugs, at least one pair of opposing upper bolster members being disposed above said flexible lug pair for bearing the weight of said stack of thin and soft sheets of material and for guiding said thin and soft sheets of material to said discharge port, each tip end of said pair of opposing upper bolster members protruding beyond the marginal edge of said discharge port downwards beyond the underside of said flexible lugs.

2. The container as claimed in claim 1, wherein said discharge port is defined by two pairs of opposing flexible lugs.

3. A container having a discharge port on the underside of said container for containing therein a stack of thin and soft sheets of material having edges overlapping folded portions of adjacent sheets so that after dispensing of one sheet a leading end of a next sheet protrudes through said discharge port to be ready for a subsequent dispensing operation by a user, said discharge port being defined by at least one pair of opposing flexible lugs and being enlarged by said one sheet when the sheet is drawn out of the container while contacting and pushing down initially one of said flexible lugs and then contacting and pushing down the other one of said flexible lugs, at least one pair of opposing upper bolster members being disposed above said flexible lug pair for bearing the weight of said stack of thin and soft sheets of material and for guiding said thin and soft sheets of material to said discharge port, each tip end of said pair of opposing upper bolster members abutting against the underside of each of the flexible lugs so that each of said pair of flexible lugs is bent downwards to guide the thin and soft sheet materials to be drawn out of said container.

4. The container as claimed in claim 3 wherein said discharge port is defined by two pairs of opposing flexible lugs.

* * * * *